United States Patent [19]

Stadler

[11] 3,994,619

[45] Nov. 30, 1976

[54] SEALING-COMPARTMENT ARRANGEMENT IN MAIN COOLANT PUMPS

[75] Inventor: Franz Stadler, Graz, Austria

[73] Assignee: Maschinenfabrik Andritz Aktiengesellschaft, Austria

[22] Filed: Aug. 26, 1975

[21] Appl. No.: 607,877

[30] Foreign Application Priority Data

Aug. 20, 1974 Austria ..... 6754/74

[52] U.S. Cl. ..... 415/110; 277/30; 415/112

[51] Int. Cl.[2] ..... F16J 15/54; F04D 29/10

[58] Field of Search ..... 415/170 A, 175, 219 C, 415/219 R, 110, 111, 112, 113, 134, 135, 138, 176; 277/30, 22

[56] References Cited

UNITED STATES PATENTS

| | | | |
|---|---|---|---|
| 1,746,990 | 2/1930 | Brown | 415/108 |
| 2,017,026 | 10/1935 | Forrest et al. | 415/134 |
| 2,737,120 | 3/1956 | Ivanoff et al. | 415/108 |
| 2,823,891 | 2/1958 | Baker et al. | 415/108 |
| 3,339,491 | 9/1967 | Malloch et al. | 415/175 |
| 3,620,639 | 11/1971 | Gaffal et al. | 415/112 |
| 3,677,659 | 7/1972 | Williams | 415/170 A |
| 3,841,791 | 10/1974 | Doolin | 415/175 |
| 3,910,714 | 10/1975 | Allen et al. | 415/108 |

FOREIGN PATENTS OR APPLICATIONS

| | | | |
|---|---|---|---|
| 477,258 | 12/1937 | United Kingdom | 415/108 |

*Primary Examiner*—Henry F. Raduazo
*Attorney, Agent, or Firm*—James E. Bryan

[57] ABSTRACT

This invention relates to an improvement in a mounting for the sealing housing in a main coolant pump having a vertical pump shaft, an impeller at the lower end of the pump housing, and the pump housing being closed at the upper end thereof by a pump cover in the region of which the sealing housing is located, the improvement comprising that said sealing housing is positioned upwardly from said pump cover, an outer pipe means connecting said pump housing and said sealing housing and passing without touching through an aperture in said pump cover, said outer pipe means having a portion of swan-neck configuration, in cross-section, in an extension of said pipe means into a region of a housing flange, and said swan-neck portion terminating in a flange between said pump housing and said pump cover.

2 Claims, 1 Drawing Figure

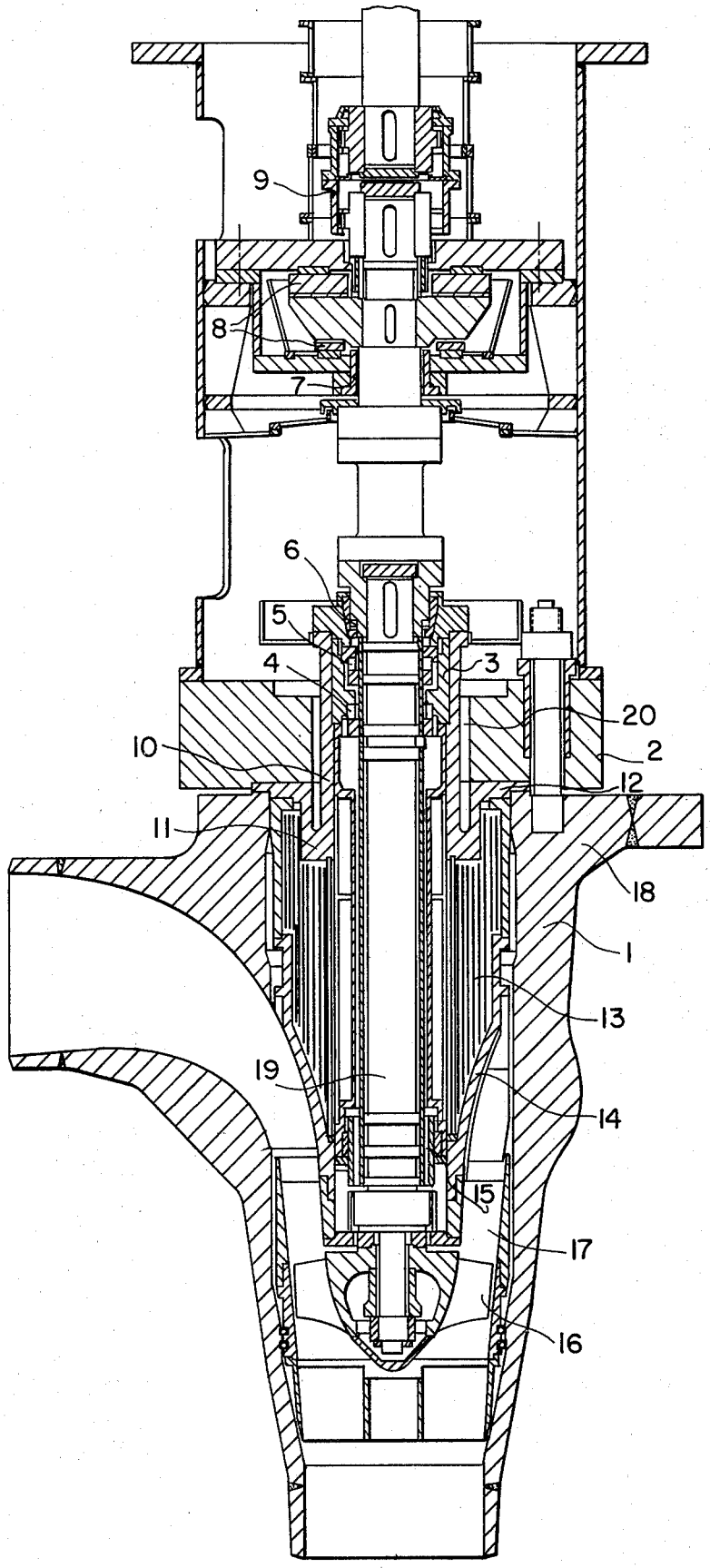
9
8
7
6
5
4
3
20
2
10
12
11
18
1
13
19
14
15
17
16

SEALING-COMPARTMENT ARRANGEMENT IN MAIN COOLANT PUMPS

This invention relates to the position of the sealing housing in main coolant pumps with vertical pump shafts, the impeller being mounted at the lower end of the pumps, the surrounding pump housing being closed at its upper end by a pump cover, and the sealing housing being supported in the region of the cover.

It is known to mount the sealing housing at the end of the pump housing in main coolant pumps, preferably in the pump cover, in order to prevent the compressed medium along the pump shaft from undesired discharge. But because such known main coolant pumps operate at relatively high temperatures, the seals are subject to much wear. In order to effectively counteract this condition, measures were taken that affect the seal side. However, success has not always been the end result.

It has been further proposed that the sealing housing mounted in the region of the pump cover, or also still in the pump housing, be protected from thermal effects by special measures. Thus it is known to mount cooling elements in the area of the seals to compensate or meet the heat accumulation. Equipment has been proposed, which operates similarly to air cooling, though installation of cooling coils and hence the use of water cooling also is known. But these steps do not cool sufficiently.

The invention addresses the problem of so mounting the sealing housing that it will be protected even more from thermal effects and to provide for the absence of interfering junction parts favoring heat flow into the sealing housing. This is achieved by the invention in that the sealing housing is pulled out and up from the pump cover, an outer pipe acting as the supporting connection to the pump housing and being inserted through the inside lateral face of the pump cover, without touching, and being of swan-neck design in its extension in the region of the housing flange, another flange being mounted at the end of the swan-neck part and clamped between the pump housing and the pump cover.

In order to be capable of additionally mounting a cooling system, or, in other words, to be able to sufficiently enlarge the surface of the outer pipe, the contact-free outer surface of the outer pipe is made of such length as to be from 1.5 to twice its diameter. Thereby the seals located in the sealing housing no longer will be subjected to enormous thermal strains and the reliability or life of operation of such a pump is appreciably extended.

The invention will be further illustrated by reference to the accompanying drawing in which the single FIGURE shows a cross-section through a main coolant pump.

The pump housing 1 is made as a casting in known manner and is assembled vertically. A flange 18 is provided at the upper end of the pump housing 1, which runs normally to the axis of the pump shaft and is of planar design. A pump cover 2 is connected thereto, sealing the pump housing 1. This is implemented in known manner by a screw or bolt connection. A pump shaft 19 is located inside the pump housing. The shaft is surrounded by insulating bodies 13 and is again surrounded by a support pipe 14. Further below in the vertical direction is located the hydrodynamic guide bearing 15. A distributor 17 is located in the flow cross-section, and an impeller 16 is mounted at the end of the pump shaft 19.

As already mentioned, the pump cover 2 is connected to the pump housing 1 at the top, a bore 20 being provided in the center of the pump cover to let the pump shaft 19 pass through. A sealing housing is provided for closure, incorporating the operating seal 4, the safety seal 5 and the rest-condition seal 6. A guide bearing 7, a thrust bearing 8 and a bevel gear coupling 9 are mounted above, but are illustrated only for the sake of completeness.

The specialty of the bearing of the invention for the sealing housing resides in the fact that the latter not only is removed from the region of the pump housing but even from that of the pump cover and in such a manner that no immediate or direct heat transfer may occur through the pump cover 2 or the pump housing 1. An outer pipe 10 acts as connection between the pump housing and the sealing housing 3. The pipe surrounds the sealing housing 3 on one hand and passes through the pump cover 2, extending into the pump housing 1 in the region of the housing flange 18, and on the other hand returns by means of a swan-neck design 11, the outer pipe 10 ending in a flange 12. The flange 12 is of such design as to be clamped between the housing flange 18 and the pump cover 2. The latter furthermore is provided with a bore 20 large enough that the outer pipe 10 may pass through it without touching. The length of the outer pipe 10 is so enlarged by the swan-neck design 11 as to be about 1.5 to twice its diameter.

This mounting of the sealing housing screens the heat flow naturally passing from the pump housing 1 to the pump cover 2. The bore 20 of the pump housing being very large, a cavity is obtained, which acts as an insulator. Cooling coils or similar heat-conducting components may be mounted therein, in known manner. Space being sufficient, the cooling elements may be designed to correspond to the quantity of heat to be transferred.

It will be obvious to those skilled in the art that many modifications may be made within the scope of the present invention without departing from the spirit thereof, and the invention includes all such modifications.

What is claimed is:

1. In a mounting for the sealing housing in a main coolant pump having a vertical pump shaft, an impeller at the lower end of the pump housing, and the pump housing being closed at the upper end thereof by a pump cover about the shaft in the region of which a sealing housing is located, the improvement comprising a sealing housing positioned upwardly from said pump cover about the shaft, an outer pipe means connecting said pump housing and said sealing housing and passing without touching through an aperture in said pump cover, said outer pipe means having a portion of swan-neck configuration, in cross-section, in an extension of said pipe means into a region of a housing flange, and said swan-neck portion terminating in a flange between said pump housing and said pump cover.

2. A mounting according to claim 1 in which said outer pipe means has a length of 1.5 to twice its diameter.

* * * * *